US005299437A

United States Patent [19]

Paugh

[11] Patent Number: 5,299,437

[45] Date of Patent: Apr. 5, 1994

[54] KEYED DOOR LOCK ASSEMBLY

[75] Inventor: Gary Paugh, Long Beach, Calif.

[73] Assignee: Anthony's Manufacturing Company, Inc., San Fernando, Calif.

[21] Appl. No.: 743,492

[22] Filed: Aug. 8, 1991

[51] Int. Cl.[5] ..... E05B 65/06

[52] U.S. Cl. ..... 70/101; 70/90; 292/44; 292/288; 292/297

[58] Field of Search ..... 70/101, 89, 90; 292/44, 292/45, 55, 288, 289, 297

[56] References Cited

U.S. PATENT DOCUMENTS

| | | | |
|---|---|---|---|
| 438,626 | 10/1890 | Kern . | |
| 485,661 | 11/1892 | Royer | 292/44 X |
| 568,638 | 9/1896 | Sweet | 292/44 |
| 735,962 | 8/1903 | Gartz . | |
| 1,434,495 | 11/1922 | Loy . | |
| 1,503,820 | 8/1924 | Dietz . | |
| 2,062,176 | 11/1936 | Hennigan | 70/90 X |
| 3,142,504 | 7/1964 | Jordan, Sr. | 292/220 |
| 3,437,365 | 4/1969 | Zadanoff et al. | 292/297 X |
| 3,620,483 | 11/1971 | Weinberger | 292/288 X |
| 3,886,771 | 6/1975 | Robins | 70/90 |
| 4,012,065 | 3/1977 | Miller | 292/288 |
| 4,102,545 | 7/1978 | Jay | 292/288 X |
| 4,915,430 | 4/1990 | Vitale | 292/288 X |
| 5,005,881 | 4/1991 | Bailey et al. | 292/45 |
| 5,114,194 | 5/1992 | Toifl et al. | 292/288 X |

FOREIGN PATENT DOCUMENTS

| | | | |
|---|---|---|---|
| 2539794 | 7/1984 | France | 70/101 |
| 2171445 | 8/1986 | United Kingdom | 292/288 |

*Primary Examiner*—Peter M. Cuomo
*Assistant Examiner*—Suzanne L. Dino
*Attorney, Agent, or Firm*—Poms, Smith, Lande & Rose

[57] ABSTRACT

A lock assembly is described for a door, the assembly including a gib having at least one flange. A locking unit has a first wall including an edge portion on the wall for sliding into the gib and for engaging the flange on the gib such that the locking unit is retained by the gib. A locking latch is movable between an unlocked position in the locking unit and a locked position such that the locking latch engages a wall in a frame when in the locked position. A second wall extends from the first wall of the locking unit in a direction substantially non-parallel to the first wall of the locking unit to keep the door closed when the locking latch is in the locked position.

20 Claims, 2 Drawing Sheets

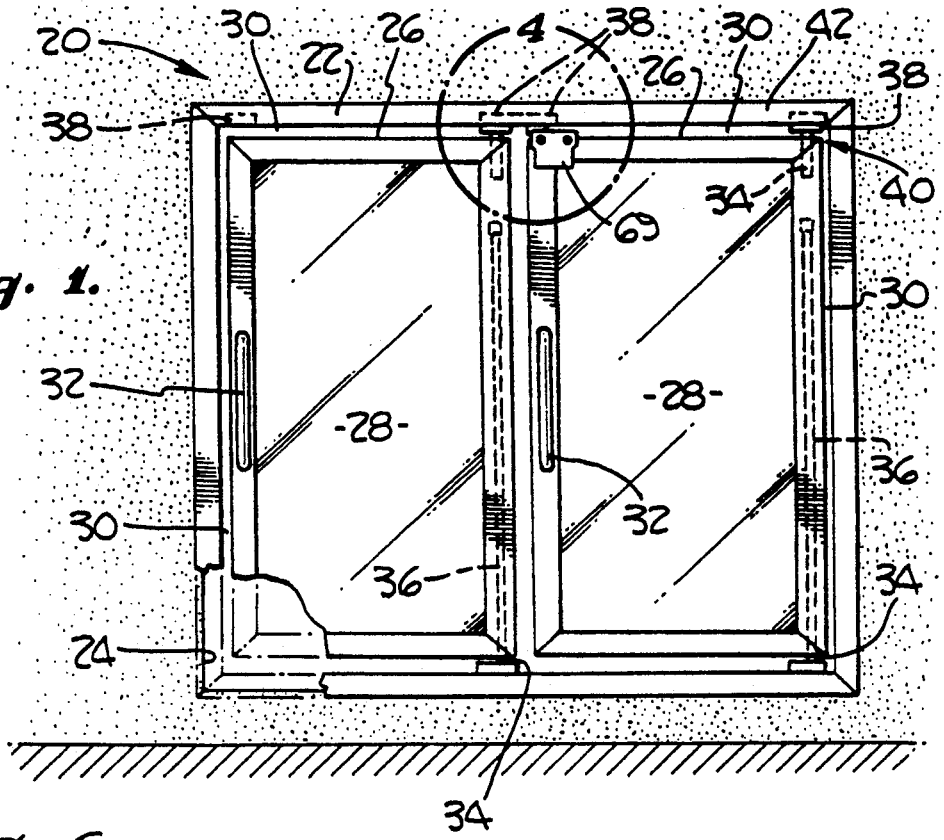
Fig. 1.
Fig. 6.
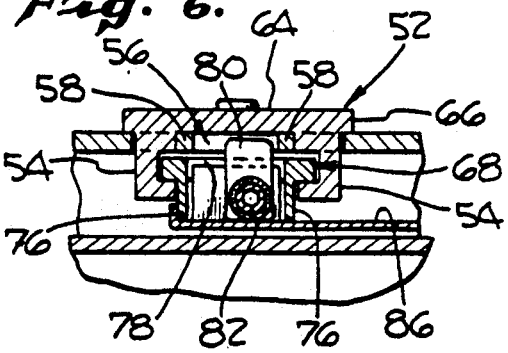
Fig. 8.
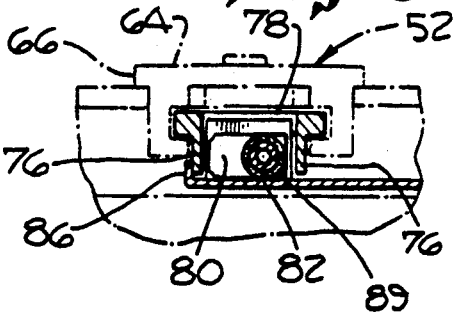
Fig. 7.
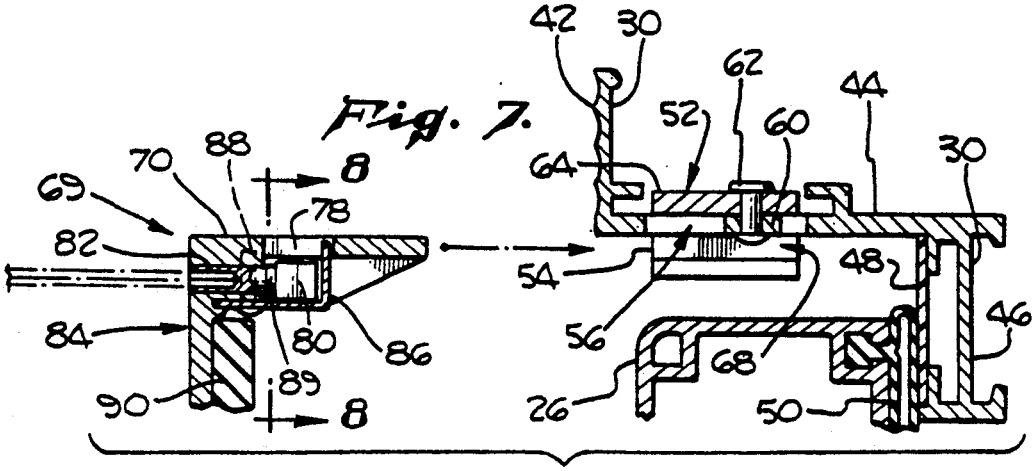

KEYED DOOR LOCK ASSEMBLY

BACKGROUND OF THE INVENTION

1. Field of the Invention

The present invention relates generally to door lock assemblies for keeping a door in a fixed position, such as door locks for keeping refrigerator display case doors closed.

2. Related Art

Commercial refrigerators and refrigerator display cases are employed in markets, food-vending operations, liquor stores and the like for the simultaneous preservation of freshness and attractive display of foods to the customer. Typically, commercial display cases have frames defining an opening for the case which is accessed through large, swinging doors having large areas of multiple-layered glazing to permit the customer to see, select and access the refrigerated product easily, while preventing heat transfer into the refrigerated space.

In some cities, grocery stores are permitted to stay open twenty-four hours per day; however, the sale of some items, such as beer and wine, have their hours of sale restricted. Thus, it would be desirable to lock the refrigerated display cases containing alcoholic beverages during the prohibited hours of sale. A lock for this purpose is described in the patent to Miller, U.S. Pat. No. 4,012,065, showing a channel-shaped body having a T-shaped slot capable of engaging a pin fastened to the display case. However, the Miller device does not prevent access by potential customers who know the construction of the device, especially since parts of the device may be visible through the glass panes of the door.

There is a need, therefore, for a lock assembly having a secure and covered lock structure which is quick and easy to use and provides a reliable lock for a door. There is also a need for a lock assembly having a removable lock which can be easily retrofit onto existing door structures, and one which is locked with an appropriate key. There is also a need for a lock assembly which includes a lock transition indication so the user can tell when the lock has made the transition between a locked and an unlocked condition. These and other needs are met by the present invention.

SUMMARY OF THE INVENTION

The present invention provides a lock assembly having a secure and hidden mechanism and which is easily retrofit onto existing doors and frames. The lock assembly includes a removable lock portion operated by a suitable key and is equally applicable to right- and left-hand opening doors. In accordance with the present invention, the lock assembly includes a mount such as a gib, as described in one embodiment, and a locking unit. The gib has at least one engagement or receiving element. The locking unit has a mating engagement portion for sliding into the engagement element of the gib and for engaging the engagement element on the gib such that the locking unit is supported by the gib. A locking element in the locking unit is movable between an unlocked position and a locked position such that the locking element locks the locking unit in engagement with the gib when in the locked position. A blocking wall extends from the mating engagement portion of the locking unit in a direction substantially non-parallel to the mating engagement portion of the locking unit to keep the door closed when the locking element is in the locked position.

The lock assembly according to the present invention preferably includes a transition means for indicating to or letting the user know when the transition has been made by the locking element between the locked and unlocked positions. In a preferred embodiment, an over-center design feature for the locking element and a plate adjacent the locking element allow the user to tell when the transition has been made, as well as providing a bias to push the locking element toward the locked or the unlocked position, depending on the direction of movement.

In a preferred embodiment of the present invention, the second wall includes a cushion which extends in the area of and faces the door when the locking unit is engaged with the gib to minimize any possible damage to the door on attempted opening of the door. The lock is preferably removable and storable away from the door when the door is to remain unlocked.

It is therefore an object of the present invention to provide a lock assembly having the above-described features.

It is also an object of the present invention to provide a lock assembly having a secure and hidden locking mechanism.

It is a further object of the present invention to provide a lock assembly having a locking unit and wherein the lock assembly can be easily retrofit to existing door and frame structures. It is an additional object of the present invention to provide a lock assembly which can be operated through an appropriate key and which has a suitable transition indication so that the user knows when the lock mechanism has been changed between the locked condition and the unlocked condition.

It is a still further object of the present invention to provide a lock assembly which can be easily used or retrofit on both right- and left-hand opening doors.

These and other objects of the present invention can be achieved with one or more of the preferred embodiments discussed in more detail in conjunction with the drawings herein and the following detailed description.

BRIEF DESCRIPTION OF THE DRAWINGS

FIG. 1 is a front elevational view of a door and frame assembly showing the lock assembly according to the present invention installed on one of the door-frame assemblies.

FIG. 6 is a front sectional view of the lock assembly and door-frame assembly taken along line 6—6 of the FIG. 5.

FIG. 7 is a right side section of the lock unit disengaged from the door-frame assembly.

FIG. 8 is a front sectional view of the lock unit disengaged from the door-frame assembly and taken along line 8—8 of FIG. 7.

DETAILED DESCRIPTION OF THE PREFERRED EMBODIMENTS

Figures 2, 3, 4, 5, 9:
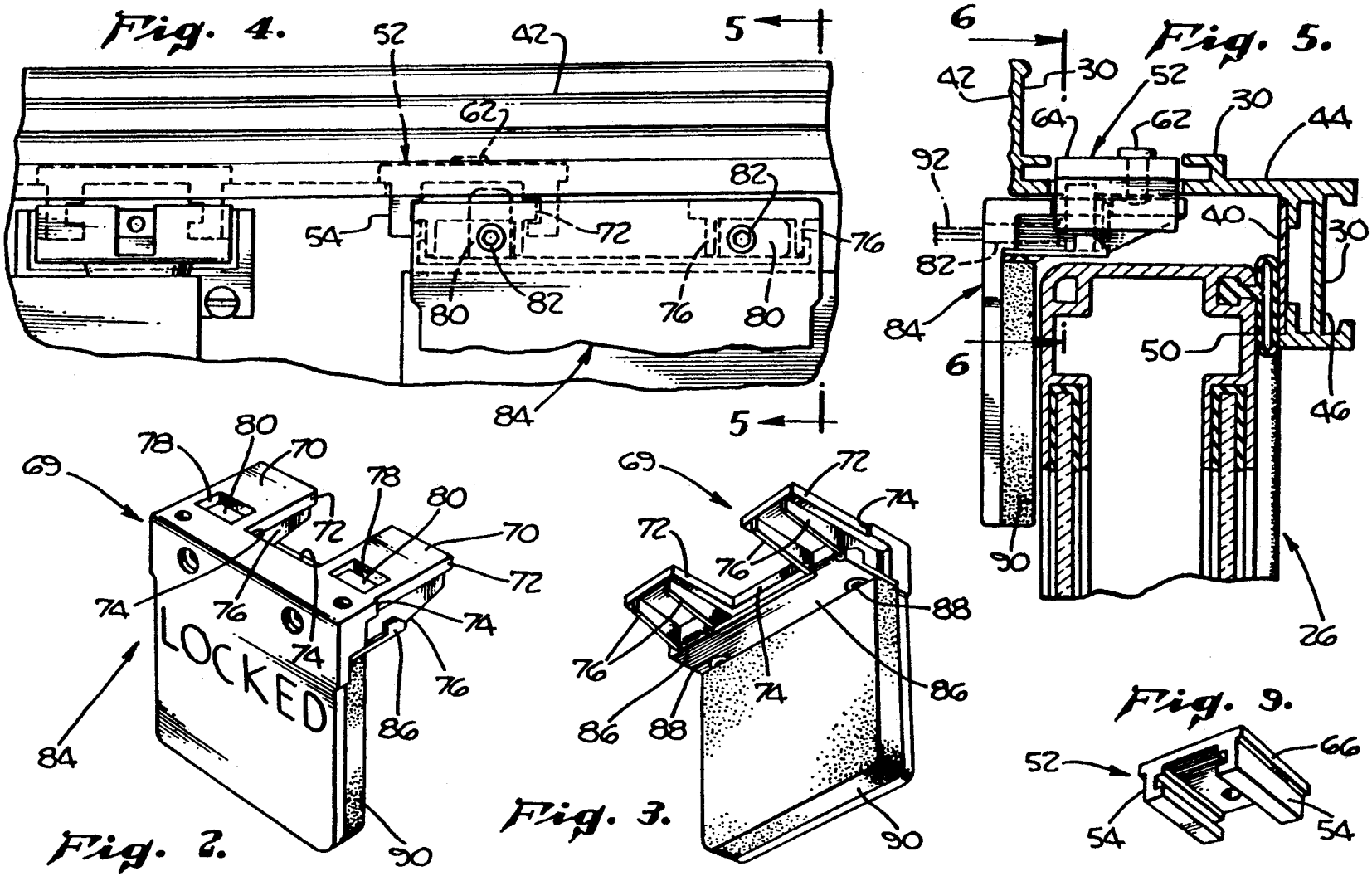
FIG. 2 is an upper right perspective view of the lock unit for use as part of the lock assembly according to the present invention.
FIG. 3 is a lower left perspective view of the lock unit of FIG. 2.
FIG. 4 is a segmented front elevational view of the lock assembly installed on the door-frame assembly of FIG. 1.
FIG. 5 is a right side section of the lock assembly and door-frame assembly taken along the line 5—5 of FIG. 4.
FIG. 9 is a bottom isometric view of the gib for use with the present invention.

In accordance with the present invention, a lock assembly is shown in FIG. 1 in the environment of a refrigerated display case and providing for a secure and reliable lock for the refrigerated display case. The lock has a secure and hidden mechanism wherein the lock is removable and is operated using a suitable key. The lock assembly of the present invention can be easily retrofit to lock right- or left-hand opening doors and is applicable to many door constructions.

In accordance with the present invention, the refrigerated display case 20 is typically found in markets, liquor stores, convenience stores and the like. These cases may be fabricated on a custom or semi-custom basis, in which the display unit 22 for the case is incorporated into the opening 24 of the refrigerated display case, which is maintained at a lower temperature by conventional refrigeration equipment (not shown). The refrigerated display case 20 may contain one or more hinged doors 26, two right-hand opening doors being illustrated in FIG. 1, each having glazed viewing areas 28.

The doors are supported by and close over frames 30 defining an opening into the refrigerated cabinet. The frame members 30 are typically fabricated from mitered extrusions, such as aluminum, joined at the corners. This enables a significant amount of detail features to be incorporated into the extrusion die, such as the gasket channels, bearing apertures and the like. Cross-sections of the frame are shown in FIGS. 5 and 7.

Glazed doors 26 typically include handles 32 and also hinges 34 at the top and bottom corners of one vertical edge for swinging outward from the refrigerated display case. The lower hinge elements typically carry the vertical loads in the door, principally resulting from the weight of the door, and both hinges must carry lateral loads applied to the door, including dynamic loads imposed on the door during opening and closing. The doors 26 may also include torque rod assemblies 36, or other spring-return mechanisms, to automatically return the doors to a closed position.

The hinge assembly includes a mounting gib and electrical connector 38 for mounting a plug-in hinge pin having a mating electrical connector for mounting in the gib at the top of a respective door to the top of the frame. Such an assembly is shown and described in U.S. Pat. No. 4,671,582. Four such mounting gibs and electrical connectors 38 are shown in FIG. 1. There are typically two mounting gibs 38 for a given door, only one of which is used depending on whether the door is a right-hand opening door or a left-hand opening door. Typically, each gib of a given pair of gibs is aligned with a respective vertical frame element for the respective door. In FIG. 1, each door is a right-hand opening door so that the hinge assembly 40 of each door engages the right-hand mounting gib of each pair of gibs. The remaining unencumbered mounting gib can then be used as part of a lock assembly for locking a door 26 closed. Alternatively, refrigerated display cases which do not incorporate the mechanisms described and shown in the prior U.S. Pat. No. 4,671,582, can be easily retrofit to accommodate the lock assembly of the present invention. The lock assembly using a retrofit gib will now be described.

In a preferred form of the invention, the frame (FIGS. 5 and 7) may be easily modified or retrofit by preferably attaching a mounting gib to the frame. Typically, the frame will have a decorative vertical molding part 42 extending over the outwardly exposed side of the opening 24 (FIG. 1). The walls of the opening to the enclosure are lined by the sill, jamb and header of the frame. This portion of the frame will hereinafter be referred to as the header 44 since the present description will be directed primarily to the top horizontal portion of the door frame, as opposed to the vertical portions of the door frame. However, it is to be understood that a gib can be easily placed at other locations on the frame to still achieve the desired objects of the present invention. When the doors 26 are closed, they generally fit within the enclosure defined by the door frame. A door stop flange 46 extends generally inwardly from the interior edge of the header 44 to stop the door and to form a thermal seal between the door 26 and the flange 46 of the frame 30. To that end, the frame is provided with a sealing element 48 extending across the outwardly facing surface of the flange which makes contact with the door and extending around the entire door frame. A gasket 50 extending around the inwardly facing side of the door forms a seal with the sealing element 48.

In the preferred embodiment, the gib 52 is rigidly mounted in openings formed in the header 44. The gib 52 is preferably mounted in that portion of the header directly over the vertical frame to which the door handle 32 is mounted, e.g., the vertical side opposite the vertical door frame portion to which the hinges are mounted, to minimize the force, and therefore the strain, created in the door frame through the gib when the handle of a locked door is pulled.

Preferably, a pair of rectangular, spaced apart and parallel extending slots are formed in the header of the door frame to accept a first engagement member in the form of flange portions or guide rails 54 (FIGS. 6 and 9) of the gib. Between the two spaced apart slots, a receptacle or opening 56 is formed in the header while still leaving sufficient material 58 (FIG. 6) for strength in the frame in the area of the lock assembly. The opening 56 is preferably formed in the header beginning at a point slightly forward of a projection defined by the forward edges of the slots and extends approximately half-way rearward in the direction of the rear projection of the slots formed in the frame. The frame header material behind the opening 56, but in front of the projection of the rear edges of the slots, forms a base 60 to which the gib 52 is riveted or otherwise fastened. The opening 56 is preferably in the front portion of the frame so that the locking unit, the remaining portion of the lock assembly described more fully below, can easily engage the gib and the latch can easily engage the frame regardless of the thickness of the door 26. However, the relative location of the opening 56 in the frame can be placed elsewhere in the frame.

The gib 52 preferably includes a connecting plate or top plate 64 providing a significant structural foundation for the gib, for providing a mounting surface for riveting the bracket to the frame and for connecting the guide rails 54. The top plate extends outwardly to top edges having dimensions sufficiently large to form an overhanging rim 66 to allow the bracket to rest on the top surface of the frame header. The guide rails 54 depend downwardly from the bottom surface of the top plate and are set inwardly from the rim 66 to define in part the rim 66. The guide rails 54 are spaced apart from each other and extend parallel to each other from the front of the bracket to the back of the bracket (see FIG. 7). On the internal surface of each guide rail, facing toward the opposite guide rail, squared, U-shaped grooves 68 form respective tracks for guiding and engaging respective shoulders (described more fully below) on the locking unit (FIG. 7).

With these gibs preexisting refrigerator display cases can be retrofit to accept the lock unit of the present invention. Very little modification of the frame is made, and no modification need be made to the refrigerator door. Gibs can be mounted in the refrigerator display case frames so that the lock units can be used with either right- or left-hand opening doors. Additionally, placing the gib on the header portion of the frame in the space between the closed door and the frame provides a convenient method for secreting and securing the locking structure to the frame. The lock mechanism of the present invention is thereby made more secure and reliable.

The locking unit 69 (FIGS. 2 and 3) includes an engagement element in the form of at least one first engagement plate and preferably two first engagement plates 70 for engaging and mating with the gib 52. Each engagement plate preferably engages only one gib at a time. Each engagement plate includes at least one and preferably two edge portions or shoulders 72 for engaging and traveling in a respective U-shaped groove 68 in the mating gib. Each shoulder extends laterally a sufficient distance to adequately engage the U-shaped grooves 68 and provide a stable lock assembly once the locking unit is engaged with the gib. The leading portions of each engagement wall 70, which first engage the gibs (as best viewed in FIG. 3), are preferably square. The laterally outward facing shoulders of each engagement plate preferably extend straight forwardly until they reach respective stop surfaces 74, which prevent further insertion of the locking unit into the corresponding gib. Support flanges 76 extend on the undersides of the engagement plates to provide enhanced structural support and stability to the locking unit when it is engaged with the gib which might arise as a result of pulling on the door handle. These support flanges are optional.

Each engagement plate includes a respective latch opening 78 to allow extension out of and retraction into the locking unit of a locking element or locking latch 80 or other suitable locking element (FIGS. 2, 6 and 7). The locking latch 80 is preferably a rectangular shaped latch integrally affixed to a round shaft 82 having a through hole either square, hexagonal or torx shaped for a suitable key (FIG. 7) which rotates the latch between a locked position shown in FIG. 6 and an unlocked position shown in FIG. 8. When in the locked position, the latch extends significantly above the engagement wall 70. While in the unlocked position, the latch rests within a cavity below the top surface of the engagement wall, the sides of which cavity are defined by the support flanges 76 or by the bias plate 86 (FIGS. 3, 7 and 8). In our embodiment, the support flanges may be omitted, in which case walls of the bias plate may be formed to enclose the latch. The shaft 82 is retained and positioned by a second blocking wall 84 (FIG. 7) described more fully below.

The locking latch 80 and shaft 82 are positioned underneath the engagement plate 70 and behind the blocking wall 84. The locking latch 80 is enclosed within these walls by a bias plate 86. The bias plate 86 includes at least one upwardly extending cover portion for each locking latch to close the space between the support flanges 76 between which the locking latch is placed, or if support flanges are omitted, the bias plate will have ends enclosing the locking latch. In the preferred embodiment, the upwardly extending cover portion extends at least partly into the latch opening 78 so that the upwardly extending cover portion serves as a bearing surface if the latch is pushed rearward as it is being turned. The bottom of the bias plate 86 extends underneath the locking latch.

The bias plate is preferably made from stainless steal or other spring-like material so that, as the locking latch and shaft 82 is rotated, one corner of the heel of the locking latch bears against the bias plate so that the corner of the locking latch and the bias plate create an over-center condition which allows the user to tell when the transition between the locked position of the locking latch and the unlocked position has been made and to bias the locking latch either to the locked or unlocked positions, depending on the starting position, until a suitable driving force is applied to the locking element. Preferably, the latch is dimensioned and positioned with the shaft relative to the bias plate so that the latch is pre-loaded when the latch is in the locked position. The preloading provides a desired substantial over-center effect as the latch is moved from the locked position to the unlocked position and to hold the latch in the locked position until a suitable driving force is applied to move the latch to the unlocked position. The bias plate is held in position on the underside of the locking unit through fasteners 88 (FIG. 7) preferably affixed to the underside of the engagement wall 70.

A nylon shim washer 89 is placed over the round shaft 82 that positions that latch axially and prevents bind in mating surfaces of the blocking wall and latch.

The blocking wall 84 of the locking unit extends downwardly from the engagement wall in a direction preferably perpendicular to the engagement wall so that the blocking plate extends over the door (FIG. 5) to keep the door closed when the locking unit is engaged with the corresponding gib and the locking latch 80 is in the locked position. A rubber or other soft resilient material cushion 90 is bonded or otherwise mounted to the rear surface of the blocking wall to absorb shocks from and prevent damage to the door in case an attempt is made to open the door.

The locking unit preferably includes two engagement walls 70 and two corresponding locking latches 80 with shafts 82. This provides more structural mass for the locking unit and surface area for the blocking wall 84. The extra surface area on the exposed surface of the blocking wall can be used for appropriate lettering, logos and arrows showing which way to operate the locking unit or to show that the particular refrigerated cabinet door is locked.

It should be understood that the first and second engagement elements can take a number of forms, such as where the first engagement element is a receiving element to enclose or engage, such as by locks or walls, the second engagement element in the form of a shaft or plate or key element. Alternatively, the first engagement element may be a pin or shaft with a locking element receptacle about which the second engagement element passes. Therefore, the particular form of the two engagement elements is not limited to the particular forms described herein for the preferred embodiments.

The remainder of the locking unit may preferably be made from aluminum or other suitable material to provide strength and durability.

In operation, the cabinet door 26 is closed and the appropriate engagement wall 70 is pushed into the gib 52 so that the shoulders 72 engage and are supported by the guide rails 54. The locking unit is pushed into the gib until such time as the stop surface 74 on the corresponding engagement wall contacts the forward edge of the outside guide rail on the gib. The locking latch is then aligned with the opening in the frame. A hex, square or torx key 92 (FIG. 5) or other suitable device is then used through a keyway to rotate the locking latch 80 and the shaft 82 so that the locking latch extends upwardly beyond the surface of the engagement wall 70 and into the opening 56 provided in the header of the frame. The resilient nature of the bias plate 86 tells the user when the locking latch has reached the locked position (FIGS. 4 and 6).

With right-hand doors, the left engagement wall is used. With left-hand doors, the plug-in hinge pin and electrical connector is placed on the left side of the door, thus freeing up the gib on the right side. In these doors, the right engagement wall is used.

The described lock combination of gib and locking unit provide a suitable lock assembly for doors which is easily retrofit onto existing door structures without substantial modification to the door frame, and without any modification necessary to the door itself. The lock assembly is applicable to both right- and left-handed opening doors and can be used on any door construction where the blocking wall 84 extends over the front of the door 26. The cushion material 90 on the back of the blocking wall minimizes any damage to the door if an attempt is made to open the door while the lock is in place. The lock assembly provides a secure and hidden locking structure accessible only by use of a suitable tool.

Although the present invention has been described in detail with reference only to the present preferred embodiments, it will be appreciated by those of ordinary skill in the art that various modifications can be made without departing from the spirit of the invention. Accordingly, the invention is limited only by the following claims.

I claim:

1. A lock assembly for a door structure wherein the door structure includes a door frame and a door mounted in the door frame for movement so that part of the door moves toward and away from a wall in the door frame, the assembly comprising:

a mount fixed relative to the door frame wall and having a first engagement member;

a locking unit having a second engagement member for slidingly engaging the first engagement member on the mount, such that the locking unit is supported by the mount before the locking unit is locked into engagement with the mount, and a blocking wall extending from the second engagement member in a direction substantially non-parallel to the second engagement member of the locking unit to keep the door closed when the locking unit engages the mount; and a locking element in the locking unit movable between an unlocked position in the locking unit and a locked position engaging a surface fixed relative to the frame such that the locking element locks the locking unit in engagement with the mount when in the locked position to keep the door closed.

2. The lock assembly of claim 1 wherein locking unit includes an insertion element and the mount includes two flange portions having shoulders for engaging the locking unit such that the insertion element on the locking unit slides between the two flange portions.

3. The lock assembly of claim 2 further comprising a frame wall defining an opening in association with which the door is mounted wherein the mount includes a connecting wall connecting the two flange portions and wherein the frame wall includes two walls defining respective openings such that the two flange portions extend through the openings and such that the connecting wall rests on and is supported by the frame wall.

4. The lock assembly of claim 3 wherein the mount is fastened to the frame wall.

5. The lock assembly of claim 3 wherein the frame wall includes a second wall defining a receptacle for the locking latch when the locking latch is in the locked position.

6. The lock assembly of claim 1 wherein the second engagement element in the locking unit includes a first slide plate for mating with the mount when the second engagement element is inserted into the mount.

7. The lock assembly of claim 6 wherein the first slide plate includes two side edges for engaging channels on the mount.

8. The lock assembly of claim 6 wherein the second engagement element further includes a wall defining an opening for the locking element such that the locking element extends through the opening when the locking element is in the locked position.

9. The lock assembly of claim 1 wherein the blocking wall of the locking unit extends substantially perpendicular to the second engagement element and further includes a wall defining a keyway for accepting a key to move the locking element between the locked and unlocked positions.

10. The lock assembly of claim 9 wherein the locking unit further includes a cushion on a side of the blocking wall facing the door to be locked for cushioning any impact between the door and the locking unit.

11. The lock assembly of claim 1 further comprising a transitional indicator for indicating when a transition has been made by the locking element between the unlocked position and the locked position.

12. The lock assembly of claim 1 further comprising a bias element for biasing the locking element toward either of the locked and unlocked positions.

13. A lock assembly for a door structure wherein the door structure includes a door frame and a door mounted in association with the door frame for movement so that part of the door moves toward and away from a wall in the door frame, the assembly comprising:

a mount fixed to the door frame wall and having a first engagement member;

a locking unit having a second engagement member for slidingly engaging the first engagement member on the mount such that the locking unit is supported by the mount before the locking unit is locked into engagement with the mount and a blocking wall extending from the second engagement member in a direction substantially non-parallel to the second engagement member of the locking unit to keep the door closed when the locking unit engages the mount;

a locking element in the locking unit movable between an unlocked position in the locking unit and a locked position engaging a surface fixed relative to the frame such that the locking element locks the locking unit in engagement with the mount when in the locked position to keep the door closed; and a transitional indicator for indicating when a transition has been made by the locking element between the unlocked position and the locked position.

14. The lock assembly of claim 13 wherein the transitional indicator includes an over-center plate contacted by the locking element.

15. The lock assembly of claim 14 wherein the locking element is dimensioned and is positioned relative to the over-center-plate so as to preload the locking element where the locking element is in the locked position.

16. The lock assembly of claim 13 wherein the locking element includes a locking latch with shaft and heel portion pivotable for contacting the plate during transition between the locked position and the unlocked position.

17. The lock assembly of claim 13 wherein the transitional indicator includes a heel portion on the locking element and a spring plate contacted by the heel portion.

18. A lock assembly for a door structure wherein the door structure includes a door frame and a door mounted in the door frame and having a vertical side portion hinged in the door frame for swinging movement so that part of the door swings toward and away from a wall in the door frame, the assembly comprising:

a mount fixed to the door frame wall and having two spaced apart flanges separated by and supported by a plate;

a locking unit having a first engagement plate including an edge portion on a first wall for sliding between the flanges on the mount and for engaging the flanges on the mount such that the locking unit is supported by the mount, a locking latch movable between an unlocked position in the locking unit and a locked position engaging the frame wall such that the locking latch locks the locking unit in engagement with the mount when in the locked position and a blocking wall perpendicular to the first wall of the locking unit to extend over a door to keep the door closed when the locking element is in the locked position; and a transitional indicator for indicating when a transition has been made by the locking element between the unlocked position and the locked position.

19. The lock assembly of claim 17 wherein the blocking plate further includes a cushion material on the blocking plate to absorb impacts between the door and the blocking plate.

20. A lock assembly for a door structure wherein the door structure includes a door frame and a door mounted in the door frame for movement so that part of the door moves toward and away from a wall in the door frame, the assembly comprising:

a mount fixed relative to the door frame wall and having a first engagement member;

a locking unit having a second engagement member for slidingly engaging the first engagement member on the mount, such that the locking unit is supported by the mount before the locking unit is locked into engagement with the mount, and a blocking wall extending from the second engagement member in a direction substantially non-parallel to the second engagement member of the locking unit to keep the door closed when the locking unit engages the mount; and a locking element mounted to the locking unit movable between a locked position engaging a surface fixed relative to the frame such that the locking element locks the locking unit in engagement with the mount when in the locked position to keep the door closed and an unlocked position out of engagement with the mount.

* * * * *